United States Patent [19]

Laupper

[11] 4,328,951

[45] May 11, 1982

[54] HYDRAULIC LIFTING DEVICE

[76] Inventor: Anton Laupper, Im Malarsch 4, 9494 Schaan Fürstentum, Liechtenstein

[21] Appl. No.: 138,118

[22] Filed: Apr. 7, 1980

[30] Foreign Application Priority Data

Apr. 13, 1979 [AT] Austria ..... 2817/79

[51] Int. Cl.[3] ..... B66F 3/00

[52] U.S. Cl. ..... 254/89 H; 187/8.5

[58] Field of Search ..... 254/2 R, 2 B, 2 C, 89 H, 254/93 R, 93 H; 187/8.47, 8.49, 8.50

[56] References Cited

U.S. PATENT DOCUMENTS 3,985,207 10/1976 Petit ..... 187/8.5

*Primary Examiner*—Robert C. Watson

*Attorney, Agent, or Firm*—Toren, McGeady & Stanger

[57] ABSTRACT

A hydraulic lifting jack including a ratchet and pawl stop mechanism which is blocked by an actuating lever pivotally mounted with a generally vertically extending rail adapted to be moved transversely to its longitudinal extension to pivot the actuating lever into and out of locking engagement with the pawl. A hydraulic device may be utilized to actuate the vertical rail.

9 Claims, 7 Drawing Figures

HYDRAULIC LIFTING DEVICE

The present invention relates generally to hydraulic lifting devices and particularly to a lifting jack including a safety locking mechanism which consists of a toothed rack and a locking pawl.

Hydraulic lifting devices, particularly lifting jacks, are utilized in various applications where it is normally required that after a load has been lifted a safety lock be engaged at a desired height level.

Various embodiments of hydraulic lifting devices are known in the prior art. Additionally, safety locking devices employing a toothed rack and a locking pawl for such hydraulic lifting devices are also known. However, it has been found that the prior art does not provide an optimum solution in this regard from the point of view of operability, effectiveness and construction.

Accordingly, the present invention is directed toward provision of a safety locking mechanism for hydraulic lifting devices which is especially effective and which may be easily operated.

SUMMARY OF THE INVENTION

The present invention may be briefly described as a hydraulic lifting mechanism particularly of the type useful as a lifting jack wherein a base member such as a vertical column has a carriage slideable movable therein. A toothed rack and a locking pawl adapted to engage each other are interposed between the sliding carriage and the base member and an actuating lever is provided to engage the locking pawl to hold the locking pawl in a locking position. The actuating lever is operably associated with a rail which extends at least approximately in a vertical direction and by lateral shifting of the vertical rail, the actuating lever is caused to pivot so that an end thereof may be brought into and out of locking engagement with the pawl.

The actuating lever engaging the locking pawl has a free end which is slideably guided at the approximately vertically extending rail, with the rail being capable of transverse adjustable movement preferably by hydraulic means which operate to shift the position of the rail transversely to its longitudinal extension.

As a result of the measures provided by the present invention, a relatively simple structural design may be created which is effective to the same degree over the entire adjusting height of the lifting device. The free end of the actuating lever is guided in the rail at each height level so that during an appropriate movement of the rail, the free end of the actuating lever will follow in a swivel motion and in this way the locking pawl will be moved toward the toothed rack. The adjusting motion of the rail may occur manually or more conveniently by utilization of a hydraulic lifting device which may comprise a hydraulic cylinder.

The locking pawl which bears the actual load may be designed with appropriate strength characteristics. However, the actuating lever and the other parts utilized for adjustment of the mechanism will not be subjected to any unusual stress because they will be moved only in a position where no load is applied to the locking pawl. This may occur, for example, by means of an appropriate hydraulic switching as a function of the lifting cylinder.

The various features of novelty which characterize the invention are pointed out with particularity in the claims annexed to and forming a part of this disclosure.

For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 3:
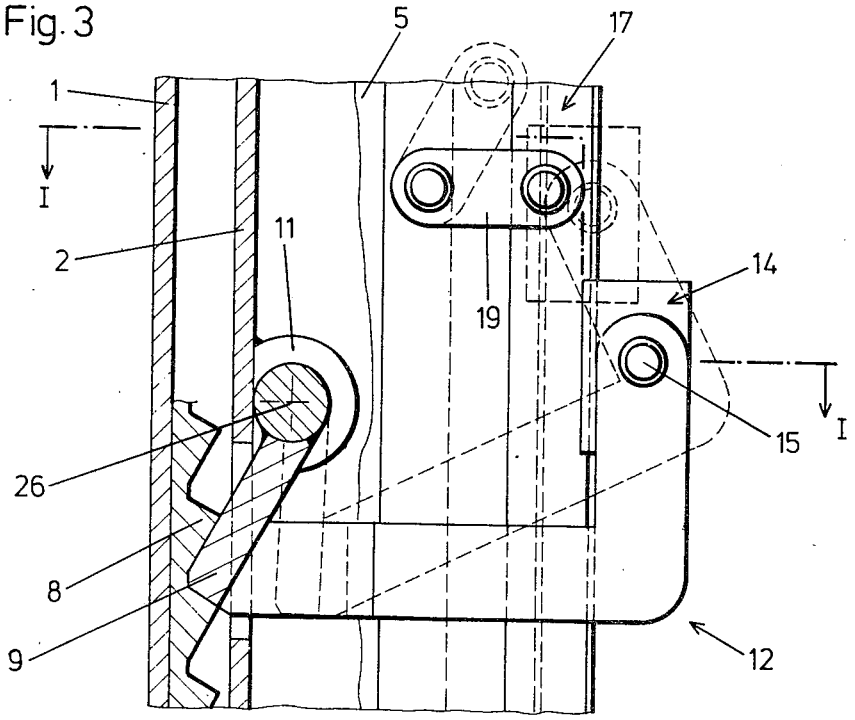
FIG. 3 is a partial vertical sectional view taken through the lifting jack embodying the present invention.
Figure 1:
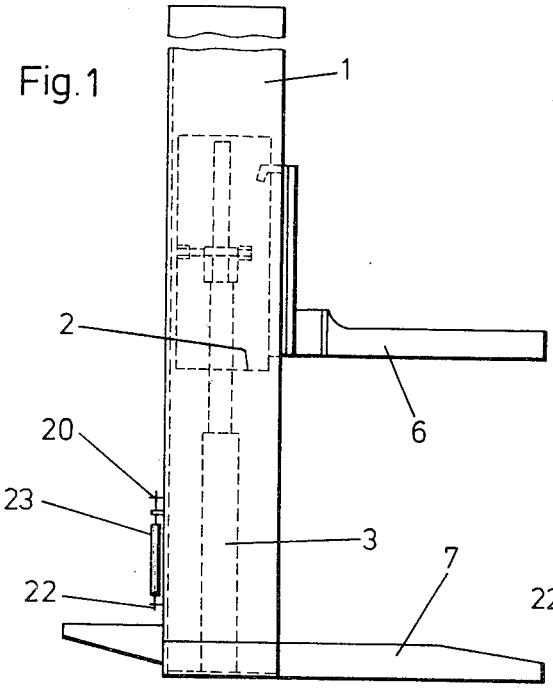
FIG. 1 is a side elevation of a hydraulic lifting jack of a type embodying the present invention.
Figure 2:
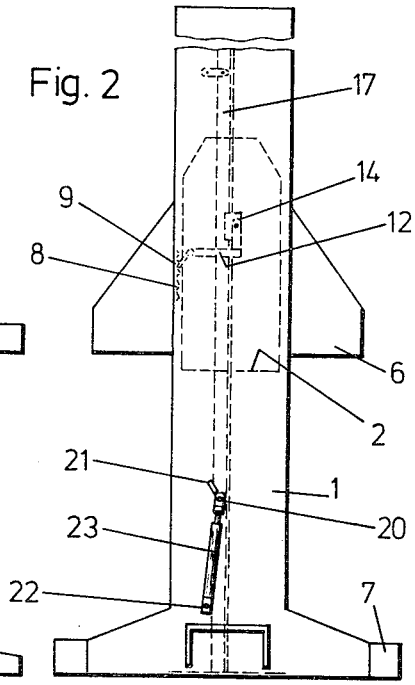
FIG. 2 is a rear view of the lifting jack of FIG. 1.
Figure 4:
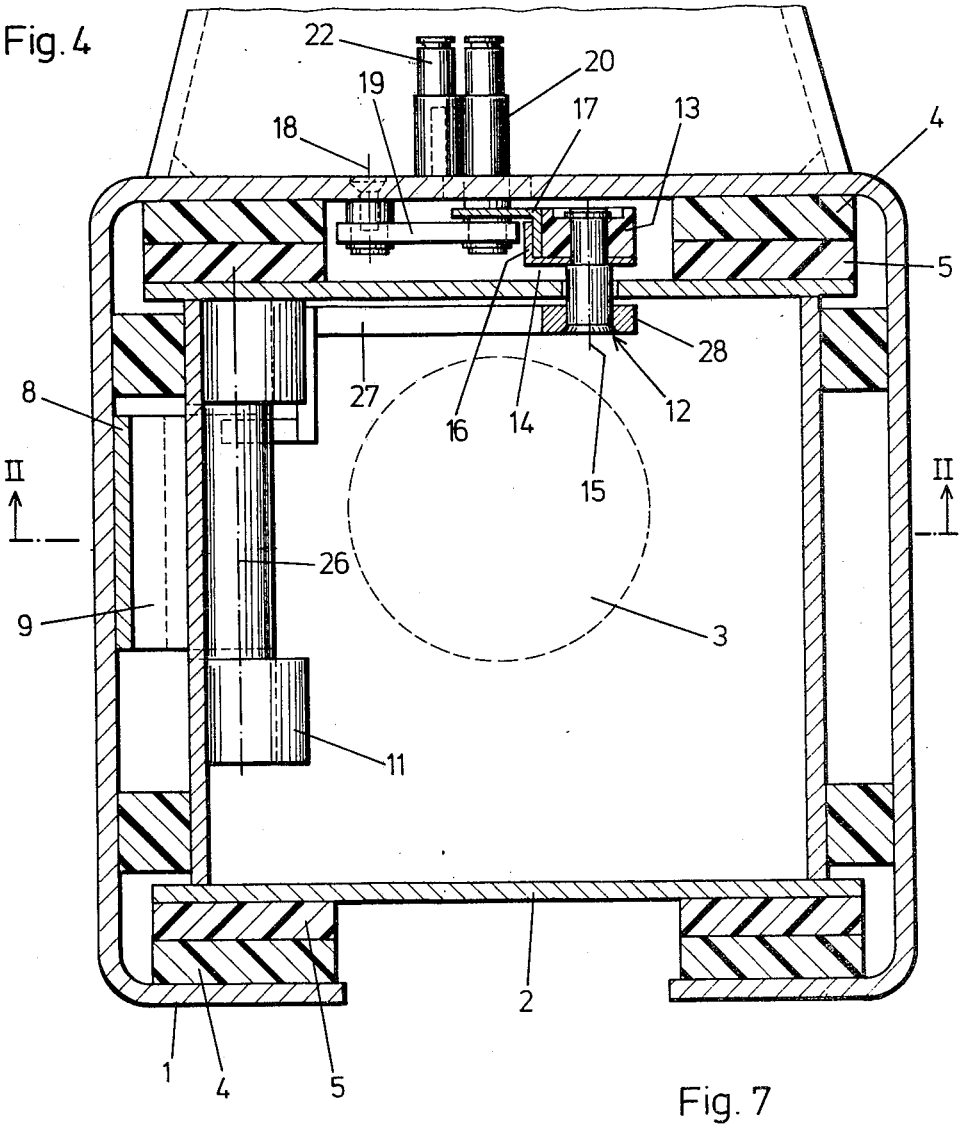
FIG. 4 is a horizontal section taken along the line I—I of FIG. 3.
Figure 5:
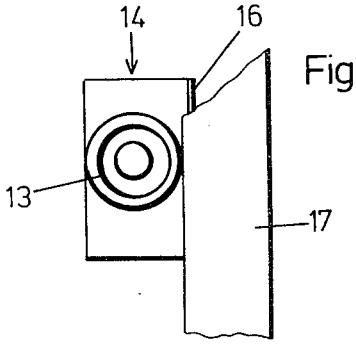
FIG. 5 is a detailed view of portions of the invention as viewed from the front of the jack.
Figure 6:
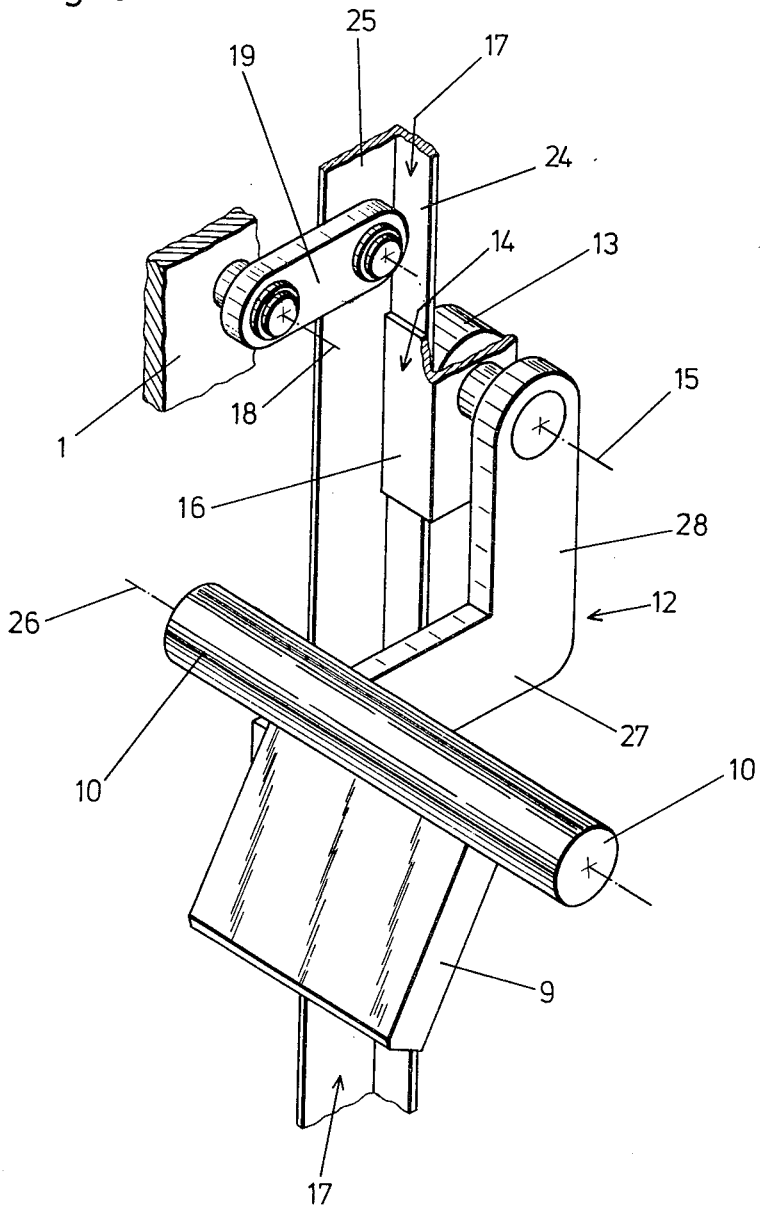
FIG. 6 is a perspective view of the principal parts of the mechanism of the invention.

Referring now to the drawings, wherein similar reference numerals are used to refer to like parts throughout the various figures thereof, a first embodiment of the invention is shown in some detail in FIGS. 3 and 4 with the clearest view for comprehending the operability of the invention begin shown in FIG. 6. As seen in FIGS. 1 and 2, a lifting jack with which the present invention may be utilized consists essentially of a vertical generally quadrilateral column 1 within which a sliding carriage 2 is installed. The sliding carriage 2 is movable in vertical directions within the column 1 by operation of a hydraulic telescopic cylinder 3.

Guide tracks 4 and 5 which are preferably made of plastic material are provided on the column 1 as well as on the sliding carriage 2. A fork member 6 is hinged or hooked upon the sliding carriage 2 and may be consequently moved vertically upwardly or downwardly together with the carriage 2. The column 1 is connected with a rack 7 constructed as a bag conveyor cart. It would also be possible to provide wheels at the rack 7 so that the entire column may be moved at random.

The invention relates basically to a safety locking mechanism by means of which the sliding carriage 2 may be mechanically secured in any desired position at which it is vertically adjusted.

For this purpose, a toothed rack 8 is provided on the inner side of the stationary column 1. A locking pawl 9 pivotally mounted on the sliding carriage 2 by an axial pin 10 rotatably set in a bearing 11 operates to engage the toothed rack 8 in releasably locking engagement. The bearing 11 is affixed on the sliding carriage 2 and the toothed rack may extend over the entire sliding range of the carriage 2 so that locking engagement may be effected at any vertical position.

An actuating lever 12 positioned to engage the locking pawl 9 comprises a free end which is guided in a movable manner at an approximately vertically extending rail 17. The rail 17 is preferably hydraulically adjustable at least transversely to its longitudinal extension.

In the embodiment shown, at the free end of the actuating lever 12 a roller 13 and an angular sliding member 14 are rotatably held about a horizontal axis 15. Between a flange 16 of the member 14 and the surface of the roller 13, there is defined a slot within which the rail 17 engages.

The rail 17 is attached in a rotatable manner at at least one strap 19 which is arranged to swivel about a horizontal axis 18. If the height of the rail 17 is adjusted, a lateral adjustment of the horizontal direction will therefore simultaneously result because the strap 19 will swivel about the axis of rotation 18. Because of this lateral movement of the rail 17, the guide parts formed from the sliding piece 14 and the roller 13 will also be swivelled in this direction so that the locking pawl 19 will move from its engaged position.

When the rail 17 is again swivelled through a return movement and is moved back to its original position, the locking pawl 19 will again necessarily be guided into its locking position.

At the bottom part of the rail 17 there is provided a bolt 20 which projects in an approximately horizontal direction therefrom. The bolt 20 is adapted to engage within a curved slot 21 which extends in a curved or oblique direction relative to the vertical in the stationary part of the lifting device embodied in the column 1.

Additionally, a stationary bolt 22 is attached at the column 1 and between the bolts 20 and 22 an hydraulic cylinder 23 is operatively arranged. Because of the curved configuration of the slot 21 and the rotatably supported strap 19, the rail 17 may be shifted in the horizontal direction parallel to itself. Of course, the rail 17 is also moved in the vertical direction due to this movement but release of the actuating lever 12 is produced principally as a result of the horizontal component of movement of the rail 17.

It would of course be within the scope of the invention to provide at the top and bottom edge areas of the device, and also if necessary in the middle area, additional straps 19. It would also be conceivable to provide at the rail 17 two or more bolts 20 located at a distance from each other each of which could engage a slot similar to the slot 21 extending obliquely or in a curved configuration.

The rail 17 is expediently configured with an L-shape as viewed in cross section so that the parts engaging at the rail may be designed in a simple structural manner. The rail 17 includes the flange 24 which engages between the guide parts at the actuating lever 12 and the strap 19 engages at another flange 25. The bolt 20 is attached at the flange 25.

In order to insure secure adjustment of the locking pawl 9, the axis of rotation 15 of the roller 13 should be provided at the free end of the actuating lever 12 to lie above the axis of rotation 26 of the locking pawl 9. In this manner, no restraining effect will occur. In this connection, it is advantageous if the actuating lever 12 is formed of two arms 27 and 28 which adjoin each other at an approximately right angle with the free arm 28 carrying the guide parts being directed upwardly. Due to the differences in height between the axes of rotation 26 and 15, during movement of the rail 17 in the horizontal direction, movement of the actuating lever 12 in an upward direction will necessarily result.

In FIG. 3, the two end positions of the locking pawl 9 are shown with the locking position being shown in a solid line form and the unlocked position being shown in broken line form in the drawing. It will be seen that during swivelling of the strap 19, the rail 17 will reach the position shown in broken line form at the left in FIG. 3. The actuating lever 12 is swivelled upwardly about the axis 26 of the locking pawl 9 by engagement of the sliding member 15 and the roller 13 with the rail 17.

Figure 7:
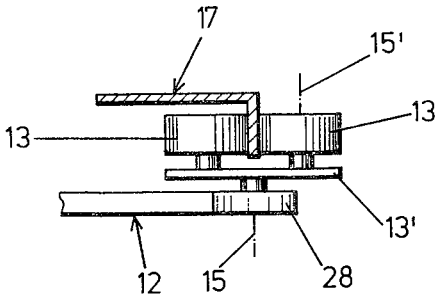
FIG. 7 is a top view partially in section showing parts of a further embodiment of the invention.

As shown in the embodiment depicted in FIG. 7, it is also possible within the scope of the present invention to provide the actuating lever 12 with two rollers 13 rotatable about horizontal axes 15' spaced a horizontal distance from each other. This arrangement may replace the arrangement of the sliding member 14 and the roller 13 previously described. As shown in FIG. 7, the approximately vertically extending rail 17 is engaged between the two rollers 13. However, in the arrangement of FIG. 7 comprising two rollers 13 there is provided a strap 13' upon which the two rollers are mounted for swivelling movement about an additional horizontally extending axis 15 so that swivelling of the actuating lever 12 will not cause jamming of the device. Additionally, only a U-shaped section could be provided, which engages with its two free flanges the rail 17. Of course in this manner, frictional forces will be correspondingly larger.

It is also possible within the scope and purview of the invention to provide more than one locking pawl 9 particularly where greater loads may be advantageously supported. Several locking pawls arranged one above the other could be provided, with the pawls engaging into the same toothed rack. Activation of such a locking pawl could be accomplished either by assigning to each locking pawl an appropriate actuating lever 12 with associated guide parts, or a single guide part could be provided wherein the actuating levers would then be located above each other and could be coupled with each other by means of an intermediate rod system. In a further embodiment it would be possible to provide two toothed racks arranged adjacent each other or adjoining each other opposite boundary walls of the column 1. In an arrangement of toothed racks opposite each other, swivelling movement released by the rail 17 would have to be reverted to the other side which could be achieved, for instance, by means of intermediate levers or by means of an appropriate modification of the locking pawl. Of course, here again a variation is conceivable wherein separate actuating levers and guide parts are assigned to the locking pawls. It would also be possible in such a case to provide two rails 17 which are moved toward opposite sides.

The embodiment of the locking pawl itself may also be varied. There may be provided two or more projections engaging into two or more recesses of the toothed rack. The locking pawl may also be designed in the form of a short counterpart to the toothed rack which, for example, is held at an actuating lever which swivels about a horizontal axis so that all teeth come into mutual engagement with the toothed rack. In a further embodiment of the locking pawl as a toothed rack, actuating levers could be assigned to both ends of such a locking pawl so that the locking pawl could be moved essentially horizontally.

The present invention is described in connection with an embodiment which comprises a hydraulic lifting jack. Of course, a safety locking device such as that of the present invention could also be applied in hydraulic lifting devices of other types. Additionally, the safety locking mechanism of the invention could also be utilized for other lifting devices which are not of the hydraulically operated type. However, the arrangement is especially advantageous for a hydraulic lifting device. By means of separate switching or controls, the telescopic cylinder 3 provided for the actual lifting and the hydraulic cylinder 23 may be adjusted relative to each other. Therefore, it would be practical that when the telescopic cylinder 3 is acted upon, the hydraulic cylinder 23 is also acted upon so that with a lifting movement the locking pawl is disengaged from the toothed rack. Immediately after the lifting movement by the telescopic cylinder 3 is stopped, the hydraulic cylinder 23 may again be operated so that the locking pawl will immediately return to its locking position. When the sliding carriage 2 first moves downwardly, an insignificant pressure action is exerted on the telescopic cylinder 3 so that the locking pawl 9 may leave its engaging position without any special mechanical stress. The locking pawl can then remain in this disengaged position until the lower position has been reached.

With regard to the present invention, the type of embodiment of the toothed rack and locking pawl is of no special significance. Of course, any type of embodiment of toothed rack or locking pawl may be used. For example, a toothed rack could also be provided with pins at a distance from each other so that practically a ladder-shaped rack would be formed wherein the locking pawl, which would then have appropriate structure, could engage with such pins or between such pins.

While specific embodiments of the invention have been shown and described in detail to illustrate the application of the inventive principles, it will be understood that the invention may be embodied otherwise without departing from such principles.

What is claimed is:

1. A hydraulic lifting mechanism particularly of the type useful as a lifting jack having a safety locking device comprising a toothed rack, a locking pawl adapted to engage said rack, an actuating lever engaging said locking pawl, a rail extending at least approximately in a vertical direction, said actuating lever having a free end which is movably guided in said rail, said rail being adjustably movable at least in directions transversely to its longitudinal extensions, and a roller and an angular sliding member mounted at a free end of said actuating lever rotatable relative thereto about a horizontal axis, said sliding member including a flange extending generally parallel to said horizonal axis with said roller and said flange defining therebetween a slot within which said rail is engaged.

2. A lifting mechanism according to claim 1 wherein said roller is mounted for rotation about a first axis and wherein said locking pawl is mounted for rotation about a second axis, said first axis being located above said second axis.

3. A lifting mechanism according to claim 2 wherein said actuating lever is formed by a pair of arms extending perpendicularly to each other with one of said arms being directed upwardly and arranged to carry guide members engaging said rail.

4. A hydraulic lifting mechanism particularly of the type useful as a lifting jack having a safety locking device comprising a toothed rack, a locking pawl adapted to engage said rack, an actuating lever engaging said locking pawl, a rail extending at least approximately in a vertical direction, said actuating lever having a free end which is movably guided in said rail, said rail being adjustably movable at least in directions transversely to its longitudinal extensions, and two rollers provided at a free end of said actuating lever and rotatably supported about a horizontal axis and at a horizontal distance from each other, said rail being engaged between said rollers.

5. A hydraulic lifting mechanism particularly of the type useful as a lifting jack having a safety locking device comprising a toothed rack, a locking pawl adapted to engage said rack, an actuating lever engaging said locking pawl, and a rail extending at least approximately in a vertical direction, said actuating lever having a free end which is movably guided in said rail, said rail being adjustably movable at least in directions transversely to its longitudinal extensions, said rail being attached in a rotatable manner to at least one strap which is arranged to be swiveled about a horizontal axis.

6. A hydraulic lifting mechanism particularly of the type useful as a lifting jack having a safety locking device comprising a toothed rack, a locking pawl adapted to engage said rack, an actuating lever engaging said locking pawl, and a rail extending at least approximately in a vertical direction, said actuating lever having a free end which is movably guided in said rail, said rail being adjustably movable at least in directions transversely to its longitudinal extensions, said rail including at least one bolt projecting approximately in a horizontal direction therefrom with said lifting mechanism including a stationary member having a curved slot defined therethrough with said bolt extending through said slot.

7. A lifting mechanism according to claim 6 further comprising a strap which is mounted for swiveled movement about a horizontal axis and which has said rail rotatably attached thereto, and wherein at one end of said rail said swivel strap engages and at the other end of said rail said bolt is attached for engagement with said curved slot.

8. A lifting mechanism according to claim 6 further comprising a hydraulic cylinder operatively engaging said bolt.

9. A hydraulic lifting mechanism particularly of the type useful as a lifting jack having a safety locking device comprising a toothed rack, a locking pawl adapted to engage said rack, an actuating lever engaging said locking pawl, and a rail extending at least approximately in a vertical direction, said actuating lever having a free end which is movably guided in said rail, said rail being adjustably movable at least in directions transversely to its longitudinal extensions, said rail being constructed with an L-shaped cross-sectional configuration to comprise a pair of flanges, with one flange engaging between guide parts mounted on said actuating lever, said mechanism further including a bolt and a swiveled strap arranged upon the other flange of said rail.

* * * * *